US008780148B2

(12) United States Patent
Ohno

(10) Patent No.: US 8,780,148 B2
(45) Date of Patent: Jul. 15, 2014

(54) LIGHT EMITTING ELEMENT ARRAY CHIP, LIGHT EMITTING ELEMENT HEAD, AND IMAGE FORMING APPARATUS

(75) Inventor: Seiji Ohno, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 14 days.

(21) Appl. No.: 13/556,523

(22) Filed: Jul. 24, 2012

(65) Prior Publication Data

US 2013/0250031 A1 Sep. 26, 2013

(30) Foreign Application Priority Data

Mar. 26, 2012 (JP) ..... 2012-070339

(51) Int. Cl.
*B41J 2/385* (2006.01)
*B41J 2/00* (2006.01)
*B41J 2/45* (2006.01)

(52) U.S. Cl.
CPC .. *B41J 2/00* (2013.01); *B41J 2/385* (2013.01); *B41J 2/45* (2013.01); *B41J 2002/453* (2013.01)
USPC ..... 347/148; 347/130; 347/238

(58) Field of Classification Search
CPC ..... B41J 2/385; B41J 2/00; B41J 2/45; B41J 2002/453
USPC ..... 347/130, 148, 238
See application file for complete search history.

(56) References Cited

U.S. PATENT DOCUMENTS

2004/0145546 A1* 7/2004 Hyuga ..... 345/76
2009/0002473 A1* 1/2009 Kitazawa ..... 347/237

FOREIGN PATENT DOCUMENTS

JP A-10-211731 8/1998
JP A-2001-353902 12/2001

* cited by examiner

*Primary Examiner* — Alessandro Amari
*Assistant Examiner* — Kendrick Liu
(74) *Attorney, Agent, or Firm* — Oliff PLC

(57) ABSTRACT

A light emitting element array chip includes first and second light emitting element rows including light emitting elements that are arranged in a main scanning direction in a zigzag, a first light emission signal line transmitting a light emission signal for allowing the light emitting elements forming the first light emitting element row to emit light, and a second light emission signal line transmitting a light emission signal for allowing the light emitting elements forming the second light emitting element row to emit light, wherein the first light emission signal line or the second light emission signal line is arranged in the main scanning direction between the first light emitting element row and the second light emitting element row and is provided in regions between the light emitting elements forming the first light emitting element row and between the light emitting elements forming the second light emitting element row.

5 Claims, 15 Drawing Sheets

LIGHT EMITTING ELEMENT ARRAY CHIP, LIGHT EMITTING ELEMENT HEAD, AND IMAGE FORMING APPARATUS

CROSS-REFERENCE TO RELATED APPLICATIONS

This application is based on and claims priority under 35 USC 119 from Japanese Patent Application No. 2012-070339 filed Mar. 26, 2012.

BACKGROUND (i) Technical Field

The present invention relates to a light emitting element array chip, a light emitting element head, and an image forming apparatus.

(ii) Related Art

In electro-photographic image forming apparatuses, such as printers, copying machines, and facsimiles, an optical recording unit irradiates a uniformly charged photoconductor with light including image information to obtain an electrostatic latent image, toner is attached to the electrostatic latent image to obtain a visible image, and the visible image is transferred and fixed onto the recording sheet, thereby forming an image. In recent years, as the optical recording unit, the following units have been used: a light-scanning-type optical recording unit that uses a laser, scans the photoconductor in the main scanning direction with laser light, and exposes the photoconductor; and an optical recording unit that uses an LED head including plural LED (Light Emitting Diode) array light sources arranged in the main scanning direction.

SUMMARY

According to an aspect of the invention, there is provided a light emitting element array chip including a first light emitting element row including light emitting elements that are arranged in a row in a main scanning direction, a second light emitting element row including light emitting elements that are arranged in a row in the main scanning direction and are provided between the light emitting elements forming the first light emitting element row such that the light emitting elements are arranged in a zigzag, a first light emission signal line that transmits a light emission signal for allowing the light emitting elements forming the first light emitting element row to emit light, and a second light emission signal line that transmits a light emission signal for allowing the light emitting elements forming the second light emitting element row to emit light, wherein the first light emission signal line or the second light emission signal line is arranged in the main scanning direction between the first light emitting element row and the second light emitting element row and is provided in regions between the light emitting elements forming the first light emitting element row and between the light emitting elements forming the second light emitting element row.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention will be described in detail with reference to the accompanying drawings.

Description of Image Forming Apparatus

Figure 1:
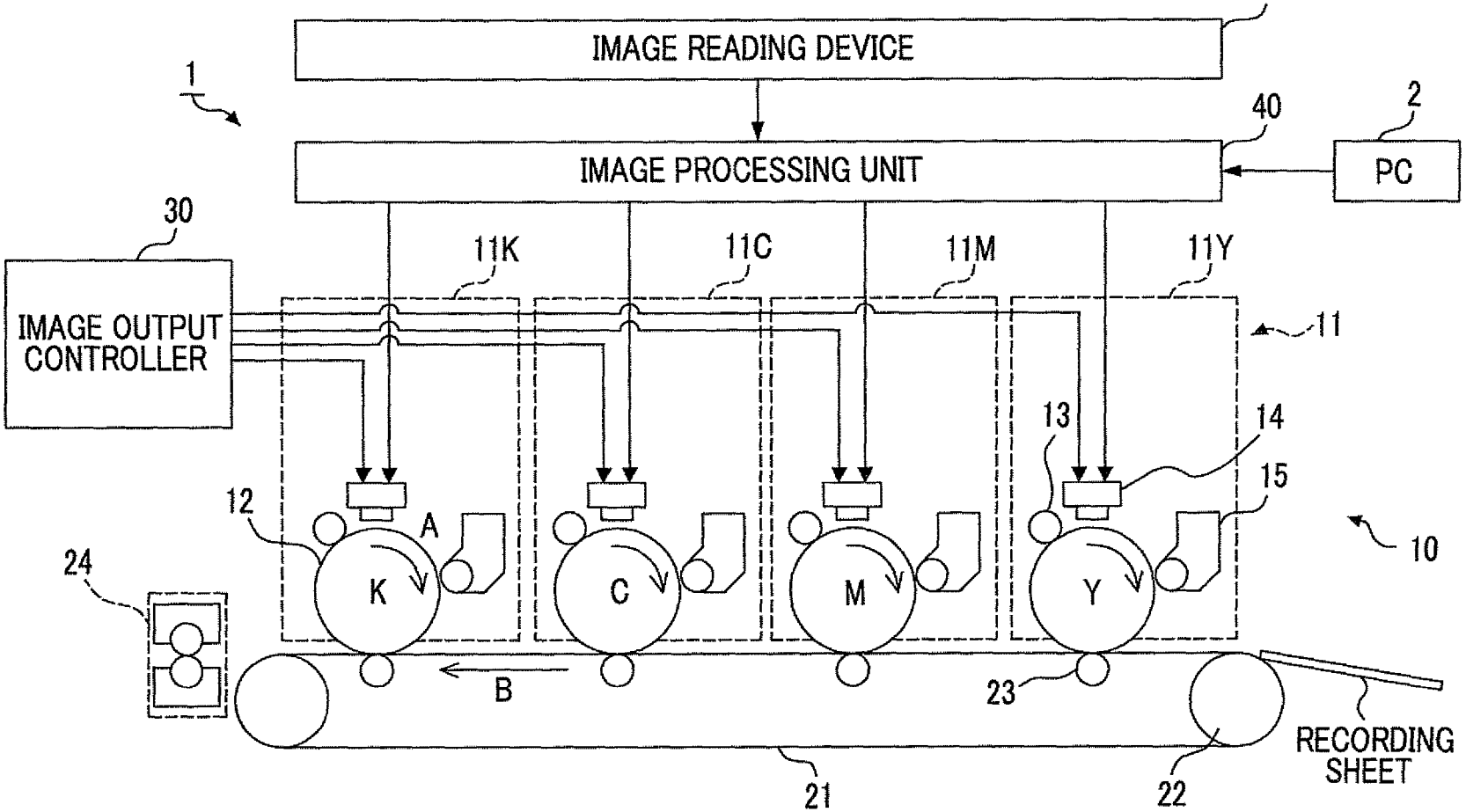
FIG. 1 is a diagram illustrating an example of the overall structure of an image forming apparatus according to an exemplary embodiment.

FIG. 1 is a diagram illustrating an example of the overall structure of an image forming apparatus according this exemplary embodiment.

An image forming apparatus 1 shown in FIG. 1 is a so-called tandem image forming apparatus. The image forming apparatus 1 includes an image forming process unit 10 that forms images corresponding to image data of each color, an image output controller 30 that controls the image forming process unit 10, and an image processing unit 40 that is connected to, for example, a personal computer (PC) 2 or an image reading device 3 and performs predetermined image processing on the image data received from the personal computer (PC) 2 or the image reading device 3.

The image forming process unit 10 includes an image forming unit 11 including plural engines which are arranged in parallel with a predetermined gap therebetween. The image forming unit 11 includes four image forming units 11Y, 11M, 11C, and 11K, which are an example of toner image forming units for forming toner images. Each of the image forming units 11Y, 11M, 11C, and 11K includes a photoconductor drum 12 which is an example of an image holding member that forms an electrostatic latent image and holds a toner image, a charger 13 that uniformly charges a photoconductor applied onto the surface of the photoconductor drum 12 with a predetermined potential, a light emitting element head 14 that exposes the photoconductor charged by the charger 13 to form the electrostatic latent image, and a developer unit 15 which is an example of a developing unit that develops the electrostatic latent image formed by the light emitting element head 14. The image forming units 11Y, 11M, 11C, and 11K have the same structure except for toner accommodated in the developer units 15. The image forming units 11Y, 11M, 11C, and 11K form yellow (Y), magenta (M), cyan (C), and black (K) toner images, respectively.

In order to multiply transfer the toner images of each color which are formed on the photoconductor drums 12 of the image forming units 11Y, 11M, 11C, and 11K onto a recording sheet, which is an example of a recording medium, the image forming process unit 10 includes a sheet transport belt 21 that transports the recording sheet, a driving roller 22 that drives the sheet transport belt 21, a transfer roller 23 which is an example of a transfer unit that transfers the toner image on the photoconductor drum 12 onto the recording sheet, and a fixing device 24 which is an example of a fixing unit that fixes the toner image to the recording sheet.

In the image forming apparatus 1, the image forming process unit 10 performs an image forming operation on the basis of various control signals supplied from the image output controller 30. Then, under the control of the image output controller 30, the image processing unit 40 performs image processing on the image data received from the personal computer (PC) 2 or the image reading device 3 and the processed image data is supplied to the image forming unit 11. For example, in the black (K) image forming unit 11K, while being rotated in the direction of an arrow A, the photoconductor drum 12 is charged with a predetermined potential by the charger 13 and is exposed by the light emitting element head 14 that emits light on the basis of the image data supplied from the image processing unit 40. In this way, an electrostatic latent image related to a black (K) image is formed on the photoconductor drum 12. Then, the electrostatic latent image formed on the photoconductor drum 12 is developed by the developer unit 15 and a black (K) toner image is formed on the photoconductor drum 12. Similarly, in the image forming units 11Y, 11M, and 11C, yellow (Y), magenta (M), and cyan (C) toner images are formed.

The toner images of each color which are formed on the photoconductor drums 12 by each image forming unit 11 are sequentially electrostatically transferred onto the recording sheet which is supplied with the movement of the sheet transport belt 21 in the direction of an arrow B by the transfer electric field applied to the transfer roller 23 such that the toner images of each color overlap each other on the recording sheet. In this way, a composite toner image is formed.

Then, the recording sheet having the composite toner image electrostatically transferred thereto is transported to the fixing device 24. The fixing device 24 performs a fixing process using heat and pressure on the composite toner image on the recording sheet transported to the fixing device 24, thereby fixing the composite toner image to the recording sheet. Then, the recording sheet is discharged from the image forming apparatus 1.

Description of Light Emitting Element Head

Figure 2:
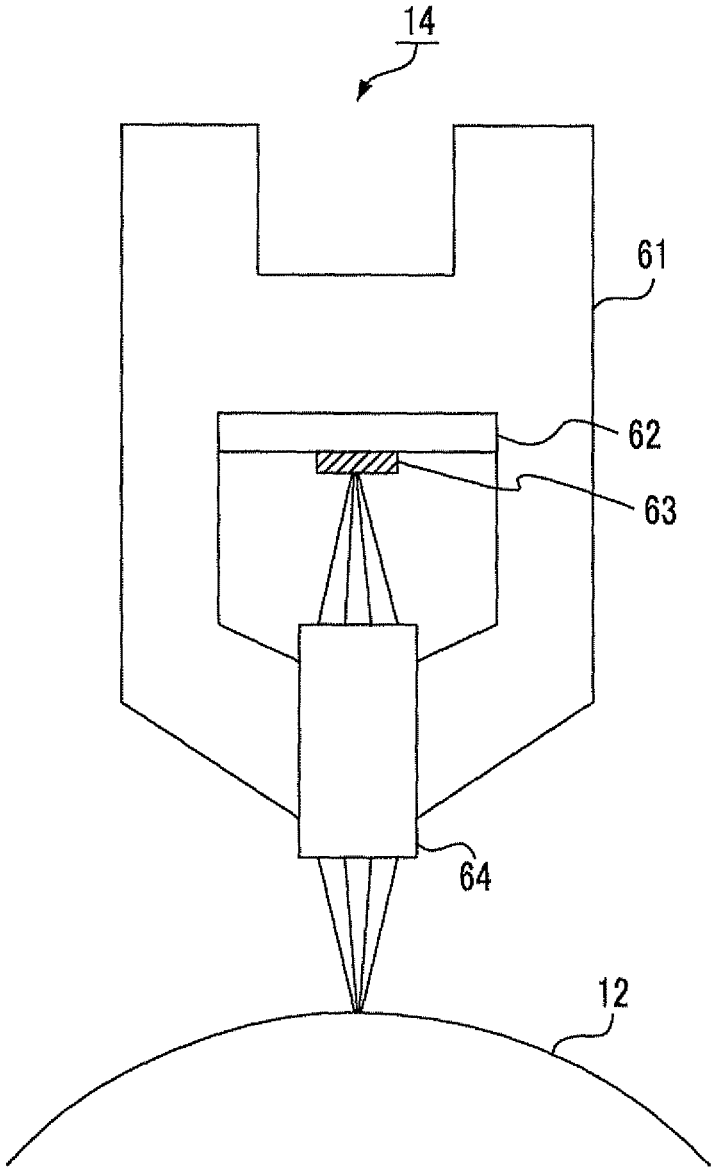
FIG. 2 is a diagram illustrating the structure of a light emitting element head according to this exemplary embodiment.

FIG. 2 is a diagram illustrating the structure of the light emitting element head 14 according to this exemplary embodiment. The light emitting element head 14 includes a housing 61, a light emitting unit 63 including plural LEDs, which are light emitting elements, a circuit board 62 having, for example, the light emitting unit 63 or a signal generating circuit 100 (see FIG. 3, which will be described below) mounted thereon, and a rod lens (diametric direction gradient index lens) array 64 which is an example of an optical element that focuses an optical output emitted from the LEDs and exposes the photoconductor such that an electrostatic latent image is formed.

The housing 61 is made of, for example, a metal material, supports the circuit board 62 and the rod lens array 64, and is set such that the light emission point of the light emitting unit 63 is aligned with the focal plane of the rod lens array 64. The rod lens array 64 is arranged along the axial direction (main scanning direction) of the photoconductor drum 12.

Description of Light Emitting Unit

Figure 3:
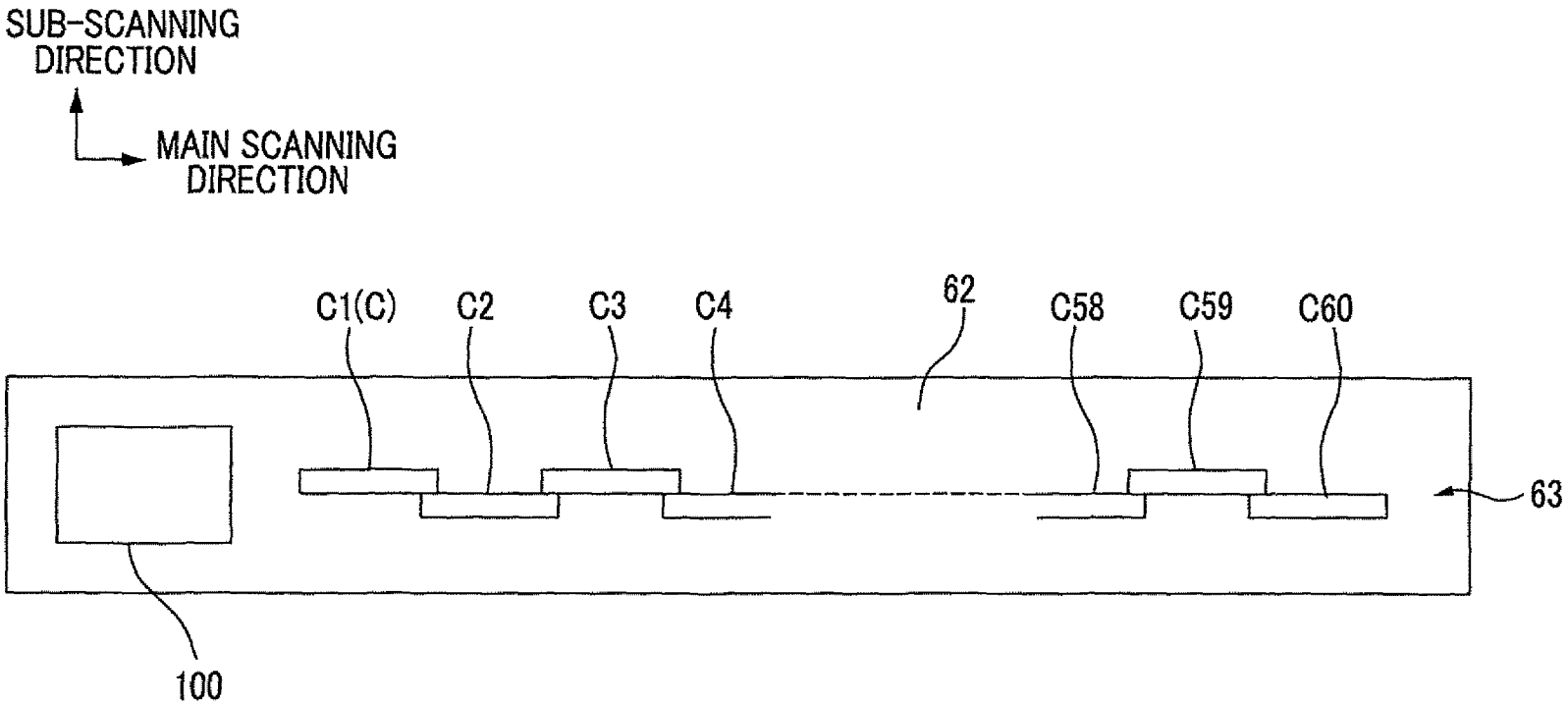
FIG. 3 is a top view illustrating a circuit board and a light emitting unit of the light emitting element head.

FIG. 3 is a top view illustrating the circuit board 62 and the light emitting unit 63 in the light emitting element head 14.

As shown in FIG. 3, the light emitting unit 63 is formed by arranging two rows of light emitting chips C (C1 to C60), which are an example of 60 light emitting element array chips, on the circuit board 62 in the main scanning direction in a zigzag. The circuit board 62 includes the signal generating circuit 100 which is an example of a controller that controls the emission of light from a light emitting element array (see FIGS. 4A and 4B, which will be described below) of the light emitting chip C.

Description of Light Emitting Element Array Chip

Figure 4A:
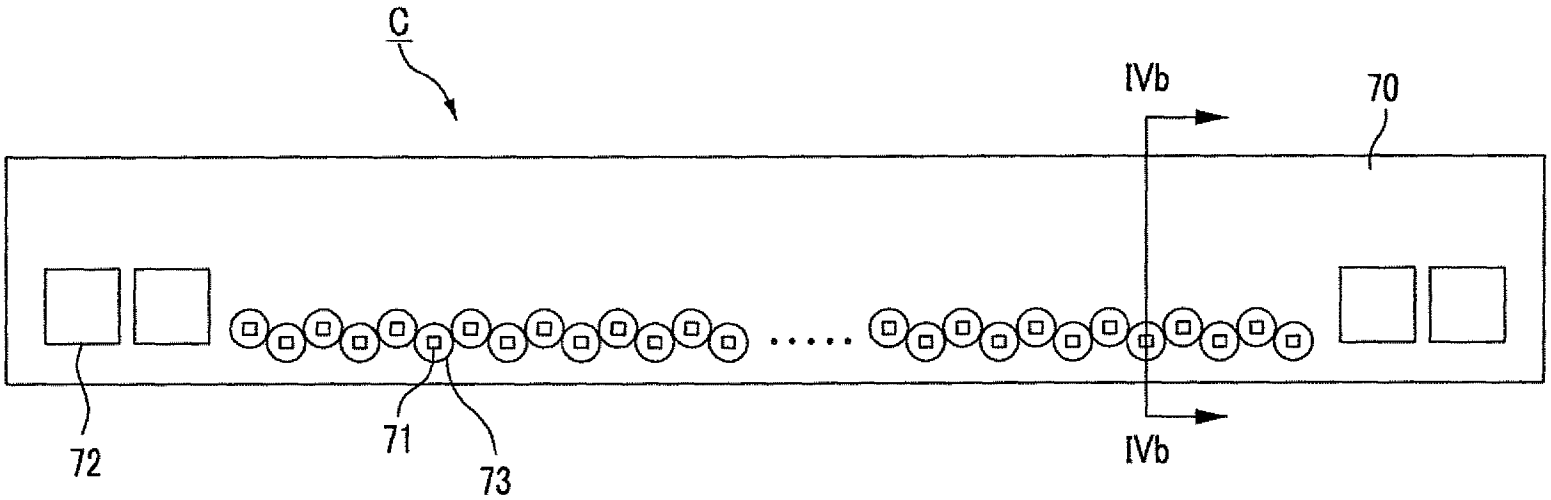
FIGS. 4A and 4B are diagrams illustrating the structure of a light emitting chip according to this exemplary embodiment.
Figure 4B:
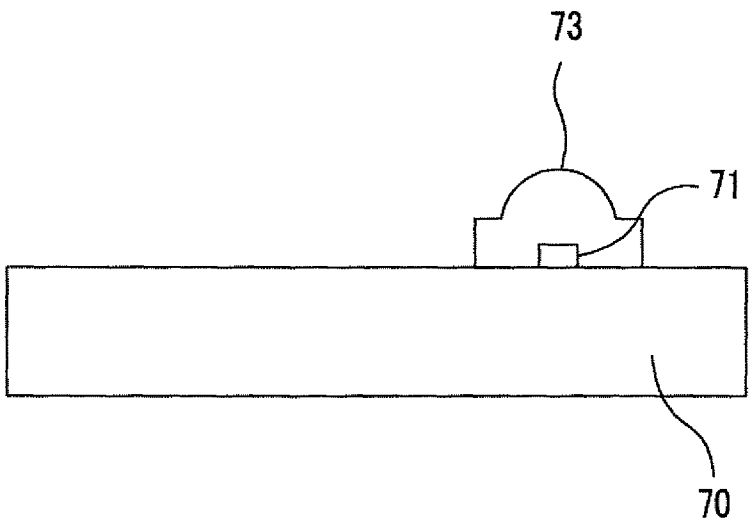

FIGS. 4A to 4B are diagrams illustrating the structure of the light emitting chip C according to this exemplary embodiment.

FIG. 4A is a diagram illustrating the light emitting chip C, as viewed from the direction in which light is emitted from the LEDs. FIG. 4B is a cross-sectional view taken along the line IVb-IVb of FIG. 4A.

The light emitting chip C includes plural LEDs 71 which are an example of the light emitting element arrays and are arranged in a row in the main scanning direction. In this exemplary embodiment, the LEDs 71 are arranged in two rows. That is, the LEDs 71 include a first light emitting element row including the LEDs 71 that are arranged in a row in the main scanning direction and a second light emitting element row including the LEDs 71 that are arranged in a row in the main scanning direction and are provided between the LEDs 71 forming the first light emitting element row such that the LEDs 71 are arranged in a zigzag, which will be described in detail below. As such, when the LEDs 71 are arranged in two rows, it is easy to increase the optical output emitted from the LEDs 71, as compared to the structure in which the LEDs 71 are arranged in a row. In addition, bonding pads 72, which are an example of electrodes that input and output signals for driving the light emitting element arrays, are provided on both sides of a substrate 70 such that the light emitting element arrays are interposed therebetween. A microlens 73 is formed on the light emission side of each of the LEDs 71. The microlens 73 focuses light emitted from the LED 71 such that light may be incident on the photoconductor drum 12 (see FIG. 2) with high efficiency.

The microlens 73 is made of a transparent resin, such as a light-curable resin, and it is preferable that the surface of the microlens 73 have an aspheric shape in order to focus light with higher efficiency. For example, the size, thickness, and focal length of the microlens 73 are determined by the wavelength of the LED 71 used and the refractive index of the light-curable resin used.

Description of Self-Scanning Light Emitting Element Array Chip

In this exemplary embodiment, it is preferable to use a self-scanning light emitting element array (SLED: Self-Scanning Light Emitting Device) chip as the light emitting element array chip which is exemplified as the light emitting chip C. The self-scanning light emitting element array chip uses a light emitting thyristor with a pnpn structure as a component of the light emitting element array chip and is configured such that the self-scanning of the light emitting element may be achieved.

Figure 5:
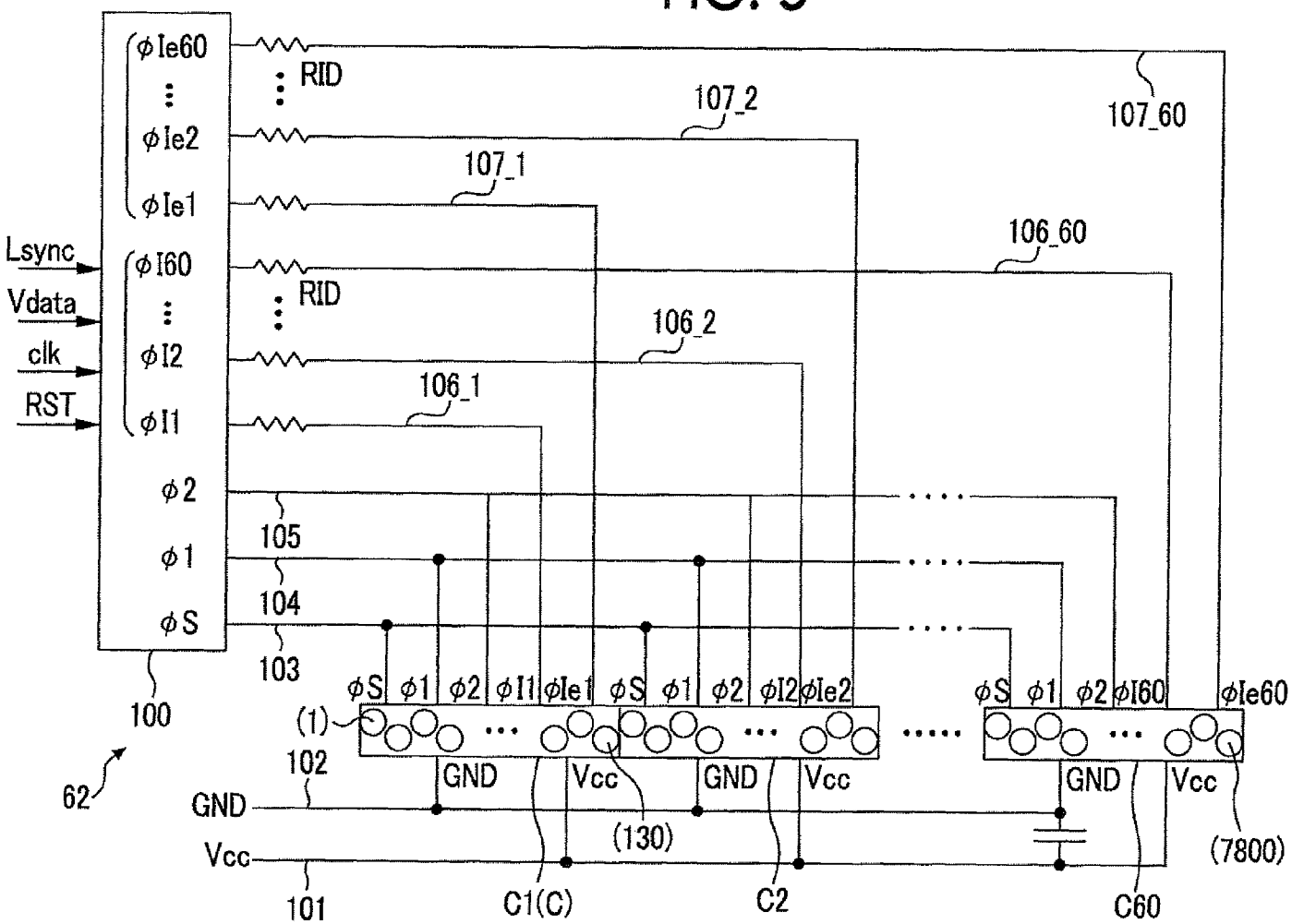
FIG. 5 is a diagram illustrating the structure of a signal generating circuit and the wiring structure of a circuit board when a self-scanning light emitting element array chip is used as the light emitting chip.

FIG. 5 is a diagram illustrating the structure of the signal generating circuit 100 and the wiring structure of the circuit board 62 when the self-scanning light emitting element array chip is used as the light emitting chip C.

The image output controller 30 (see FIG. 1) inputs various control signals, such as a line synchronization signal Lsync, image data Vdata, a clock signal clk, and a reset signal RST, to the signal generating circuit 100. The signal generating circuit 100 performs, for example, a process of sorting the image data Vdata or a process of correcting an output value on the basis of various control signals input from the outside and outputs light emission signals ϕI (ϕI1 to ϕI60) and ϕIe (ϕIe1 to ϕIe60) to each of the light emitting chips C (C1 to C60). In this exemplary embodiment, the light emission signals ϕI (ϕI1 to ϕI60) and ϕIe (ϕIe1 to ϕIe60) are supplied one by one to the light emitting chips C (C1 to C60).

The signal generating circuit 100 outputs a start transmission signal ϕS, a first transmission signal ϕ1, and a second transmission signal ϕ2 to each of the light emitting chips C1 to C60 on the basis of various control signals input from the outside.

A power line 101 for a power supply voltage Vcc=−5.0 V which is connected to a Vcc terminal of each of the light emitting chips C1 to C60 and a power line 102 for ground which is connected to a GND terminal are provided on the circuit board 62. In addition, a start transmission signal line 103, a first transmission signal line 104, and a second transmission signal line 105 for respectively transmitting the start transmission signal ϕS, the first transmission signal ϕ1, and the second transmission signal ϕ2 of the signal generating circuit 100 are provided on the circuit board 62. Furthermore, 60 light emission signal lines 106 (106_1 to 106_60) for outputting the light emission signals ϕI (ϕI1 to ϕI60) from the signal generating circuit 100 to each of the light emitting chips C (C1 to C60) and 60 light emission signal lines 107 (107_1 to 107_60) for outputting the light emission signals ϕIe (ϕIe1 to ϕIe60) are provided on the circuit board 62. In addition, 60 light emitting current limiting resistors RID for preventing an excess current from flowing to the 60 light emission signal lines 106 (106_1 to 106_60) and the 60 light emission signal lines 107 (107_1 to 107_60) are provided on the circuit board 62. Each of the light emission signals ϕ1 to ϕI60 and the light emission signals ϕIe1 to ϕIe60 have two states, that is, a high level (H) and a low level (L), which will be described below. The low level is a potential of about −5.0 V and the high level is a potential of about ±0.0 V.

Figure 6:
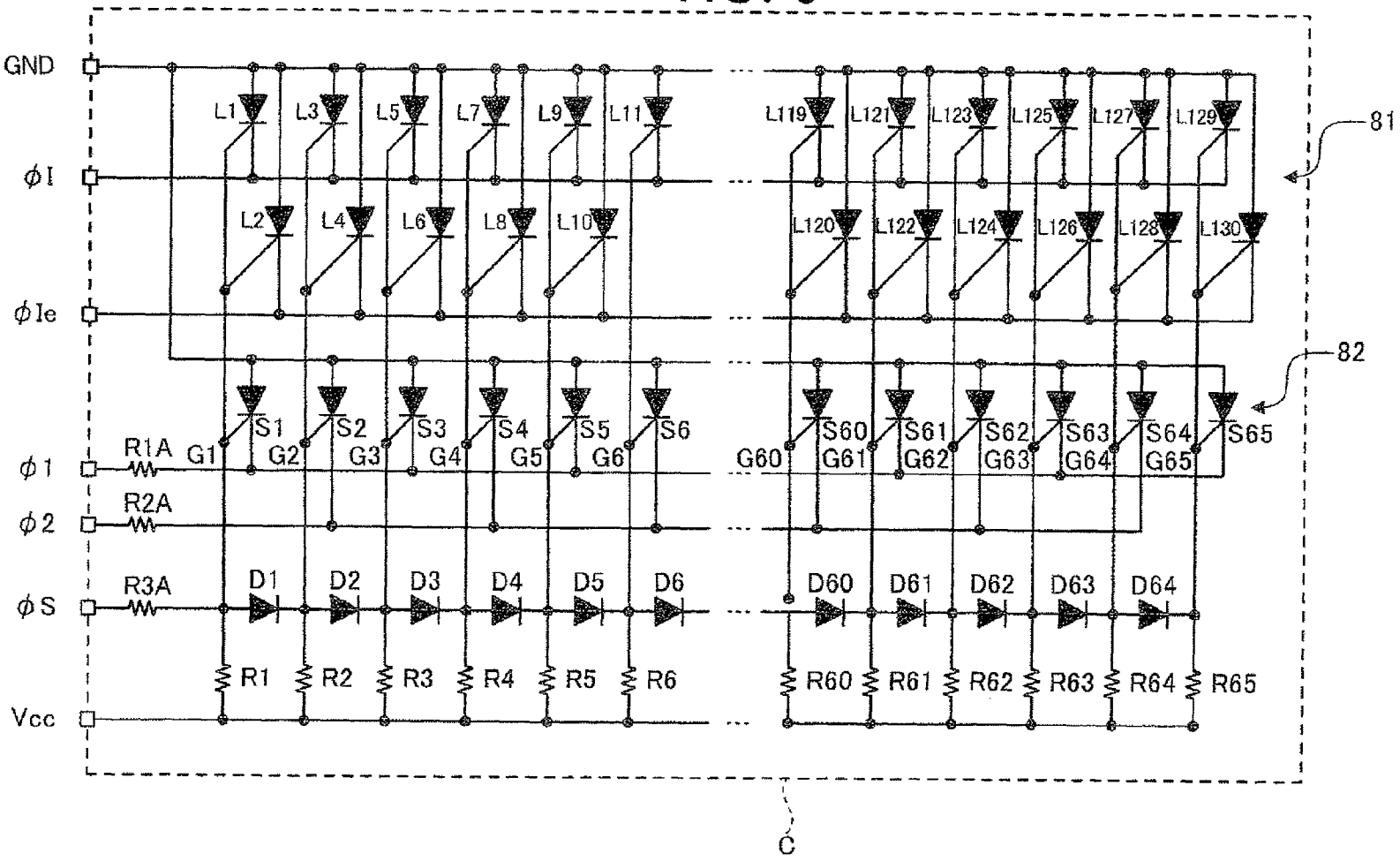
FIG. 6 is a diagram illustrating the circuit structure of the light emitting chip.

FIG. 6 is a diagram illustrating the circuit structure of each of the light emitting chips C (C1 to C60).

The light emitting chip C includes 65 transmission thyristors S1 to S65 and 130 light emitting thyristors L1 to L130. The light emitting thyristors L1 to L130 have the same pnpn junction as the transmission thyristors S1 to S65 and also function as light emitting diodes (LEDs) using a pn junction. In addition, the light emitting chip C includes 64 diodes D1 to D64 and 65 resistors R1 to R65. Furthermore, the light emitting chip C includes transmission current limiting resistors R1A, R2A, and R3A that prevent an excess current from flowing to the signal lines through which the first transmission signal ϕ1, the second transmission signal ϕ2, and the start transmission signal ϕS are supplied. The light emitting thyristors L1 to L130 forming a light emitting element array 81 are arranged in the order of L1, L2, . . . , L129, L130 from the left side of FIG. 6 and form a light emitting element row, that is, the light emitting element array 81. Similarly, the transmission thyristors S1 to S65 are arranged in the order of S1, S2, . . . , S64, S65 from the left side of FIG. 6 and form a switching element row, that is, a switching element array 82. The diodes D1 to D64 are arranged in the order of D1, D2, . . . , D63, D64 from the left side of FIG. 6. The resistors R1 to R65 are arranged in the order of R1, R2, . . . , R64, R65 from the left side of FIG. 6.

Next, the electrical connection of the elements in the light emitting chip C will be described.

The anode terminal of each of the transmission thyristors S1 to 565 is connected to the GND terminal. The power line 102 (see FIG. 5) is connected to the GND terminal and is grounded.

The cathode terminals of the odd-numbered transmission thyristors S1, S3, . . . , S65 are connected to a ϕ1 terminal through the transmission current limiting resistor R1A. The first transmission signal line 104 (see FIG. 5) is connected to the ϕ1 terminal and the first transmission signal ϕ1 is supplied to the ϕ1 terminal.

The cathode terminals of the even-numbered transmission thyristors S2, S4, . . . , S64 are connected to a ϕ2 terminal through the transmission current limiting resistor R2A. The second transmission signal line 105 (see FIG. 5) is connected to the ϕ2 terminal and the second transmission signal ϕ2 is supplied to the ϕ2 terminal.

The gate terminals G1 to G65 of the transmission thyristors S1 to S65 are connected to the Vcc terminal through the resistors R1 to R65 which are provided so as to correspond to the transmission thyristors S1 to S65, respectively. The power line 101 (see FIG. 5) is connected to the Vcc terminal and the power supply voltage Vcc (about −5.0 V) is supplied to the Vcc terminal.

The gate terminals G1 to G65 of the transmission thyristors S1 to S65 are connected to the gate terminals of the light emitting thyristors L1 to L130 in the ratio of one to two. That is, the gate terminal G1 is connected to the gate terminals of the light emitting thyristors L1 and L2. The gate terminal G2 is connected to the gate terminals of the light emitting thyristors L3 and L4 and the gate terminal G3 is connected to the gate terminals of the light emitting thyristors L5 and L6. The gate terminals G4 to G65 are connected to the corresponding gate terminals in the same way as described above. Finally, the gate terminal G65 is connected to the gate terminals of the light emitting thyristors L129 and L130.

The anode terminals of the diodes D1 to D64 are connected to the gate terminals G1 to G64 of the transmission thyristors S1 to S64, respectively. The cathode terminals of the diodes D1 to D64 are connected to the gate terminals G2 to G65 of the adjacent transmission thyristors S2 to S65 in the next stages. That is, the diodes D1 to D64 are connected in series to each other so as to be interposed between the gate terminals G1 to G65 of the transmission thyristors S1 to S65.

The anode terminal of the diode D1, that is, the gate terminal G1 of the transmission thyristor S1 is connected to the ϕS terminal through the transmission current limiting resistor R3A. The start transmission signal ϕS is supplied to the ϕS terminal through the start transmission signal line 103 (see FIG. 5).

The anode terminals of the light emitting thyristors L1 to L130 are connected to the GND terminal, similarly to the anode terminals of the transmission thyristors S1 to S65.

The cathode terminals of the odd-numbered light emitting thyristors L (light emitting thyristors L1, L3, . . . , L127, L129) are connected to the ϕI terminal. The light emission signal line 106 (in the case of the light emitting chip C1, the light emission signal line 106_1: see FIG. 5) is connected to the ϕI terminal, and the light emission signal ϕ1 (in the case of the light emitting chip C1, the light emission signal ϕI1) is supplied to the ϕI terminal. The corresponding light emission signals ϕI2 to ϕI60 are supplied to the other light emitting chips C2 to C60. The cathode terminals of the even-numbered light emitting thyristors L (light emitting thyristors L2, L4, . . . , L128, L130) are connected to the ϕIe terminal. The light emission signal line 107 (in the case of the light emitting chip C1, the light emission signal line 107_1: see FIG. 5) is connected to the ϕIe terminal and the light emission signal ϕIe (in the case of the light emitting chip C1, the light emission signal ϕIe1) is supplied to the ϕIe terminal. The corresponding light emission signals ϕIe2 to ϕIe60 are supplied to the other light emitting chips C2 to C60. The light emission signal line 106 functions as a first light emission signal line that transmits a light emission signal for allowing the odd-numbered light emitting thyristors L forming the first light emitting element row to emit light and the light emission signal line 107 functions as a second light emission signal line that transmits a light emission signal for allowing the even-numbered light emitting thyristors L forming the second light emitting element row to emit light, which will be described in detail below.

Figure 7:
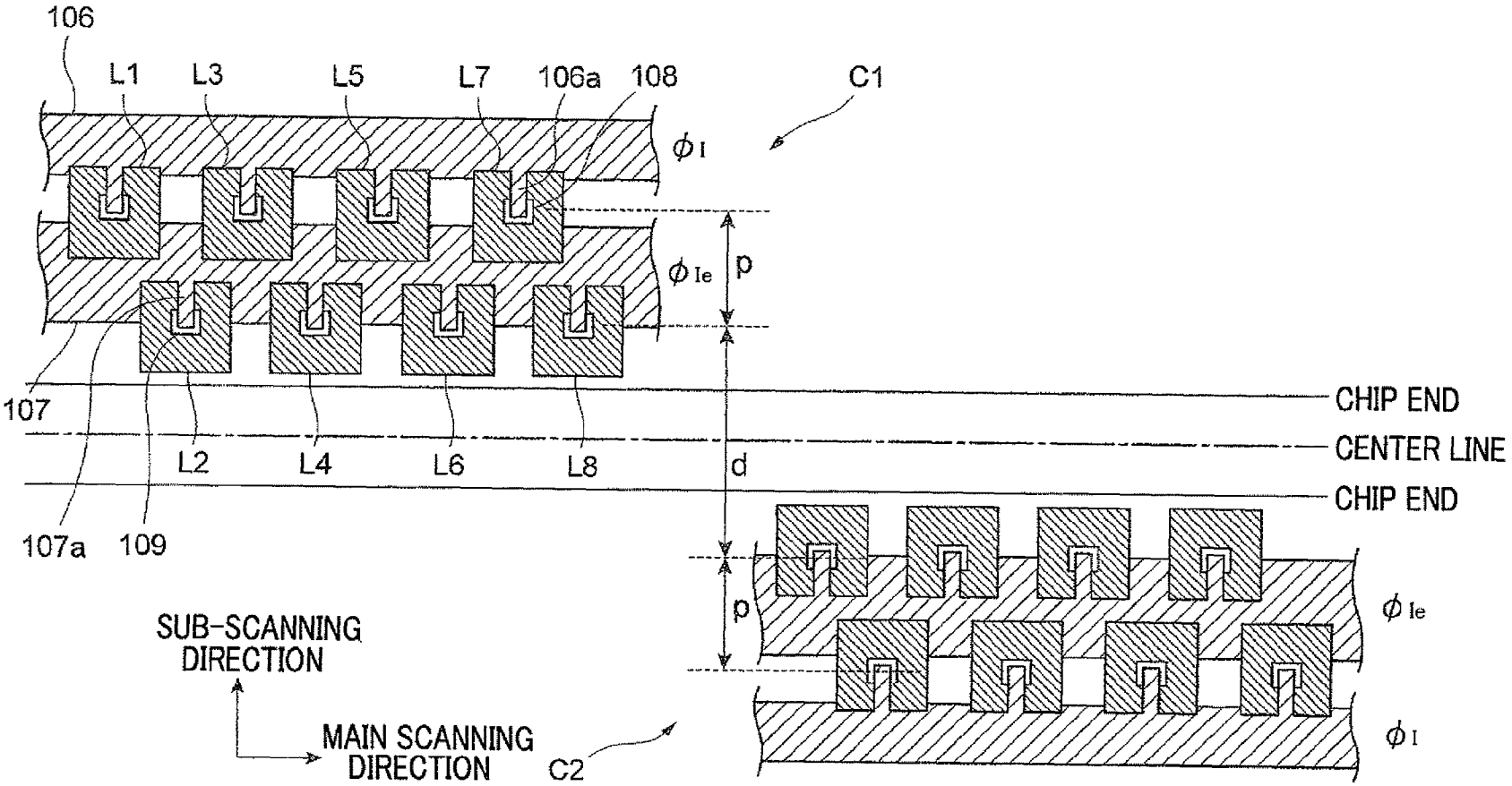
FIG. 7 is a diagram illustrating in detail the arrangement of light emitting thyristors and light emission signal lines in this exemplary embodiment.

Description of Arrangement of Light Emitting Thyristors and Light Emission Signal Lines FIG. 7 is a diagram illustrating in detail the arrangement of the light emitting thyristors L, the light emission signal lines 106, and the light emission signal lines 107 in this exemplary embodiment. Hereinafter, the light emitting chip C1 shown in FIG. 7 will be described as an example. For convenience of explanation, FIG. 7 shows the positions of a chip end, which is the end of the light emitting chip C, and an adjacent light emitting chip C2 when the light emitting chips C are arranged in a zigzag as shown in FIG. 3. In this case, the adjacent light emitting chip C2 is arranged upside down with respect to the light emitting chip C1.

As shown in FIG. 7, the light emitting chip C according to this exemplary embodiment includes the first light emitting element row including the odd-numbered light emitting thyristors L (light emitting thyristors L1, L3, . . . , L127, L129) which are arranged in a row in the main scanning direction and the second light emitting element row including the even-numbered light emitting thyristors L (light emitting thyristor L2, L4, . . . , L128, L130) which are arranged in a row in the main scanning direction and are provided between the odd-numbered light emitting thyristors L forming the first light emitting element row such that the light emitting thyristors L are arranged in a zigzag. The light emitting chip C further includes the light emission signal line 106 which is an example of the first light emission signal line that transmits the light emission signal for allowing the odd-numbered light emitting thyristors L forming the first light emitting element row to emit light and the light emission signal line 107 which is an example of the second light emission signal line that transmits the light emission signal for allowing the even-numbered light emitting thyristors L forming the second light emitting element row to emit light.

A branch line 106*a* extends from the light emission signal line 106 to an electrode 108 that is provided in the vicinity of the center of the odd-numbered light emitting thyristor L from the upper side of FIG. 7 and the light emission signal ϕI is supplied from the light emission signal line 106 to the electrode 108 through the branch line 106*a*. Similarly, a branch line 107*a* extends from the light emission signal line 107 to an electrode 109 that is provided in the vicinity of the center of the even-numbered light emitting thyristor L from the upper side of FIG. 7 and the light emission signal ϕIe is supplied from the light emission signal line 107 to the electrode 109 through the branch line 107*a*.

In the light emitting chip C1, the light emission signal line 106 is arranged on the upper side of the first light emitting element row in FIG. 7. The light emission signal line 107 is arranged in the main scanning direction between the first light emitting element row and the second light emitting element row. In addition, the light emission signal line 107 protrudes toward regions between the odd-numbered light emitting thyristors L forming the first light emitting element row and between the even-numbered light emitting thyristors L forming the second light emitting element row.

When the light emission signal line 107 is arranged in this way, it is possible to reduce the internal resistance of the light emission signal line 107. In addition, it is possible to reduce the distance between the second light emitting element row and the chip end. Therefore, it is possible to reduce the distance (the distance between the second light emitting element rows of adjacent light emitting chips C) d between the even-numbered light emitting thyristors L of the light emitting chip C1 and the adjacent light emitting chip C2. As a result, it is possible to arrange the light emitting thyristors L so as to be close to the center line (for example, a line represented by a one-dot chain line in FIG. 7) of the rod lens array 64 for focusing the optical output emitted from the light emitting thyristor L in the sub-scanning direction and thus the focus performance of the rod lens array 64 is likely to be improved.

Next, the above will be described in detail while showing the arrangement of the light emission signal line 107 according to the related art.

Figure 8:
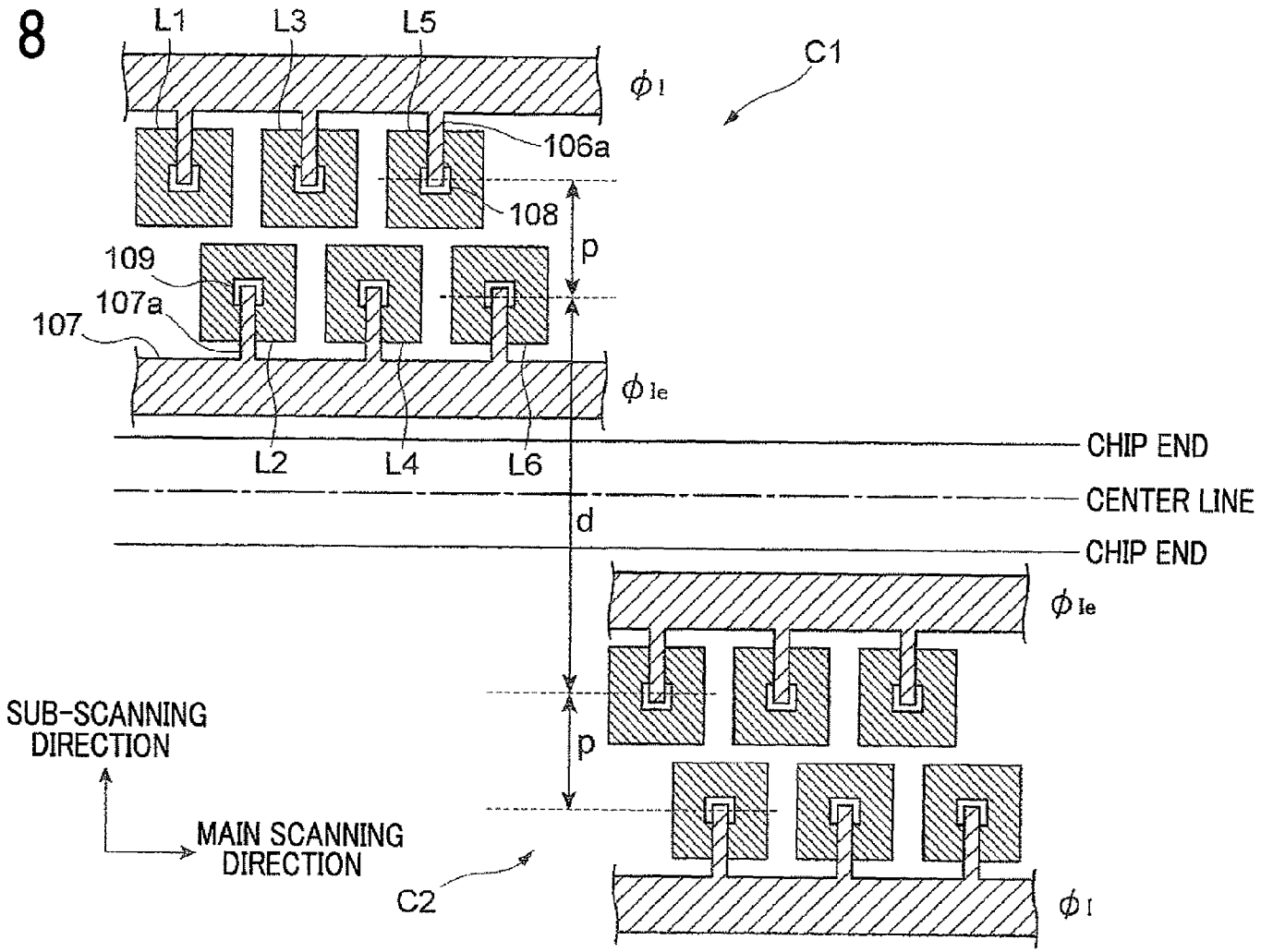
FIG. 8 is a diagram illustrating the arrangement of light emitting thyristors and light emission signal lines in the related art.
Figure 9:
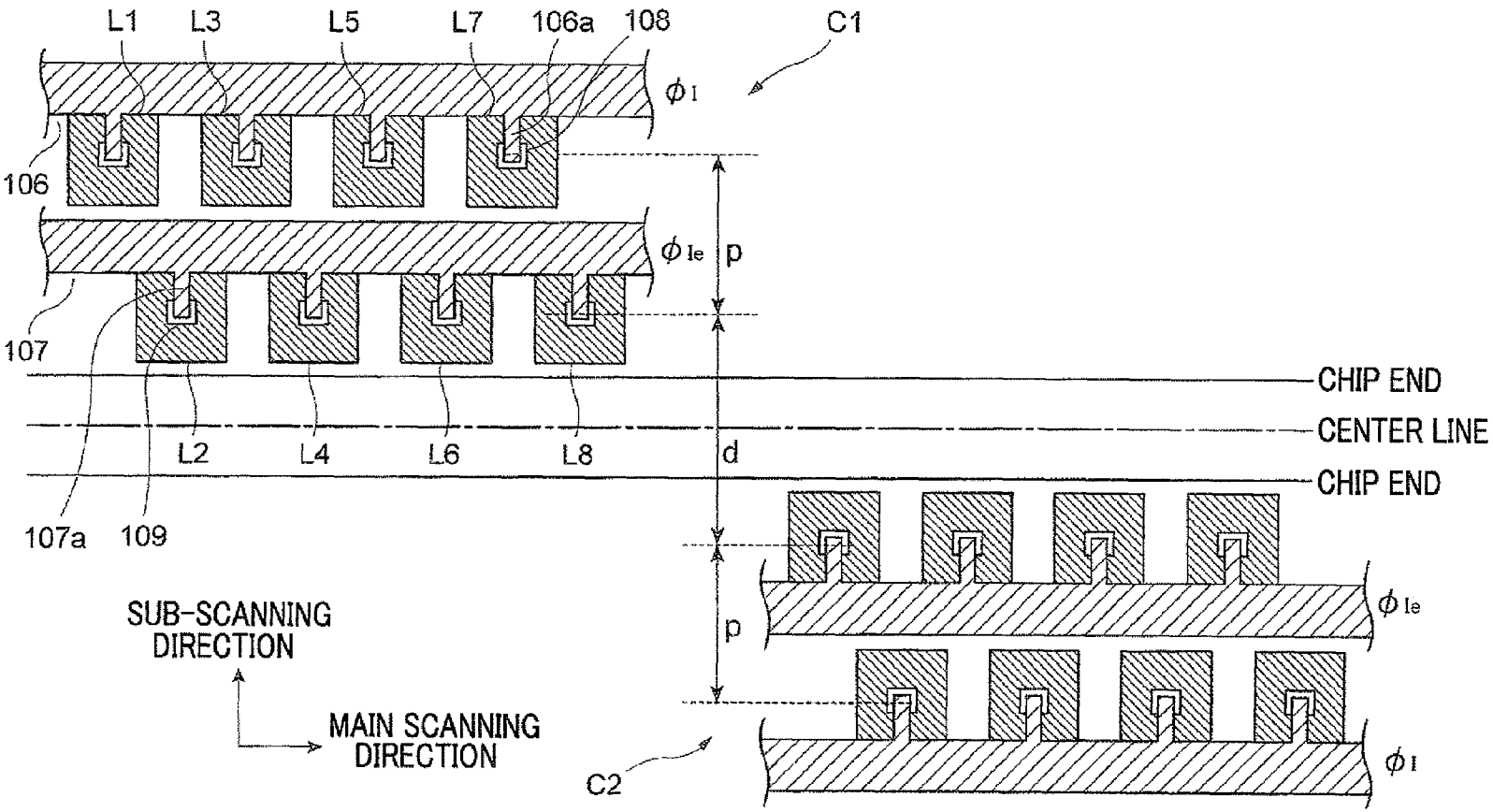
FIG. 9 is a diagram illustrating the arrangement of the light emitting thyristors and the light emission signal lines in the related art.

FIGS. 8 and 9 are diagrams illustrating the arrangement of the light emitting thyristors L, the light emission signal lines 106, and the light emission signal lines 107 according to the related art. Hereinafter, the light emitting chip C1 will be described as an example in FIGS. 8 and 9. Similarly, for convenience of explanation, FIGS. 8 and 9 show the positions of a chip end, which is the end of the light emitting chip C1, and an adjacent light emitting chip C2 when the light emitting chips C are arranged in a zigzag as shown in FIG. 3. In this case, the adjacent light emitting chip C2 is arranged upside down with respect to the light emitting chip C1.

Among the light emitting chips, the light emitting chip C1 shown in FIG. 8 is similar to the light emitting chip C1 shown in FIG. 7 in that it includes a first light emitting element row including the odd-numbered light emitting thyristors L which are arranged in a row in the main scanning direction and a second light emitting element row including the even-numbered light emitting thyristors L which are arranged in a row in the main scanning direction and are provided between the odd-numbered light emitting thyristors L forming the first light emitting element row such that the light emitting thyristors L are arranged in a zigzag. In addition, the light emitting chip C1 shown in FIG. 8 is similar to the light emitting chip C1 shown in FIG. 7 in that it further includes a light emission signal line 106 which transmits a light emission signal for allowing the odd-numbered light emitting thyristors L forming the first light emitting element row to emit light and a light emission signal line 107 which transmits a light emission signal for allowing the even-numbered light emitting thyristors L forming the second light emitting element row to emit light. Furthermore, the light emitting chip C1 shown in FIG. 8 is similar to the light emitting chip C1 shown in FIG. 7 in that the light emission signal line 106 is arranged on the upper side of the first light emitting element row in FIGS. 8 and 9.

However, the light emitting chip C1 shown in FIG. 8 differs from the light emitting chip C1 shown in FIG. 7 in that the light emission signal line 107 is arranged on the lower side of the second light emitting element row in FIG. 8. In this example, two light emission signal lines 107 are provided between the light emitting thyristors L of the light emitting chip C1 and the adjacent light emitting chip C2 when the light emitting chips C are arranged in a zigzag. Therefore, the distance d is more than that shown in FIG. 7 by at least a value corresponding to the light emission signal line 107. Thus, the distance of the light emitting thyristors L from the center line of the rod lens array 64 in the sub-scanning direction increases and the focus performance of the rod lens array 64 is likely to deteriorate.

The light emitting chip C1 shown in FIG. 9 is similar to the light emitting chip C1 shown in FIG. 7 in the basic arrangement of the light emitting thyristors L, the light emission signal line 106, and the light emission signal line 107. However, the light emission signal line 107 does not protrude toward the regions between the odd-numbered light emitting thyristors L forming the first light emitting element row and between the even-numbered light emitting thyristors L forming the second light emitting element row. In this case, in order to reduce the internal resistance of the light emission signal line 107, the thickness of the light emission signal line 107 needs to be equal to or greater than a predetermined value. Therefore, a gap p between the first light emitting element row and the second light emitting element row in the light emitting chip C1 is more than that in FIG. 7. As a result, the distance of the odd-numbered light emitting thyristors L forming the first light emitting element row from the center line of the rod lens array 64 in the sub-scanning direction increases and the focus performance of the rod lens array 64 is likely to deteriorate.

In the light emitting chip C1 shown in FIG. 7, the light emission signal line 107 protrudes toward the regions between the odd-numbered light emitting thyristors L forming the first light emitting element row and between the even-numbered light emitting thyristors L forming the second light emitting element row. Therefore, it is possible to obtain the same effect as that when the thickness of the light emission signal line 107 is increased by a value corresponding to the protruding portion. As a result, even when the gap p between the first light emitting element row and the second light emitting element row is reduced, the internal resistance of the light emission signal line 107 is likely to be reduced.

That is, according to the light emitting chip C1 shown in FIG. 7, it is possible to reduce the distance d between the second light emitting element rows of adjacent light emitting chips C (in this case, the light emitting chip C1 and the light emitting chip C2) and reduce the gap p between the first light emitting element row and the second light emitting element row in the light emitting chip C1. That is, according to the light emitting chip C1 shown in FIG. 7, it is possible to reduce both the distance d and the gap p.

The light emission signal line 107 shown in FIG. 7 partially protrudes toward the regions between the odd-numbered light emitting thyristors L forming the first light emitting element row and between the even-numbered light emitting thyristors L forming the second light emitting element row. However, the protruding portion may be further extended so as to surround the even-numbered light emitting thyristors L forming the second light emitting element row.

Figure 10:
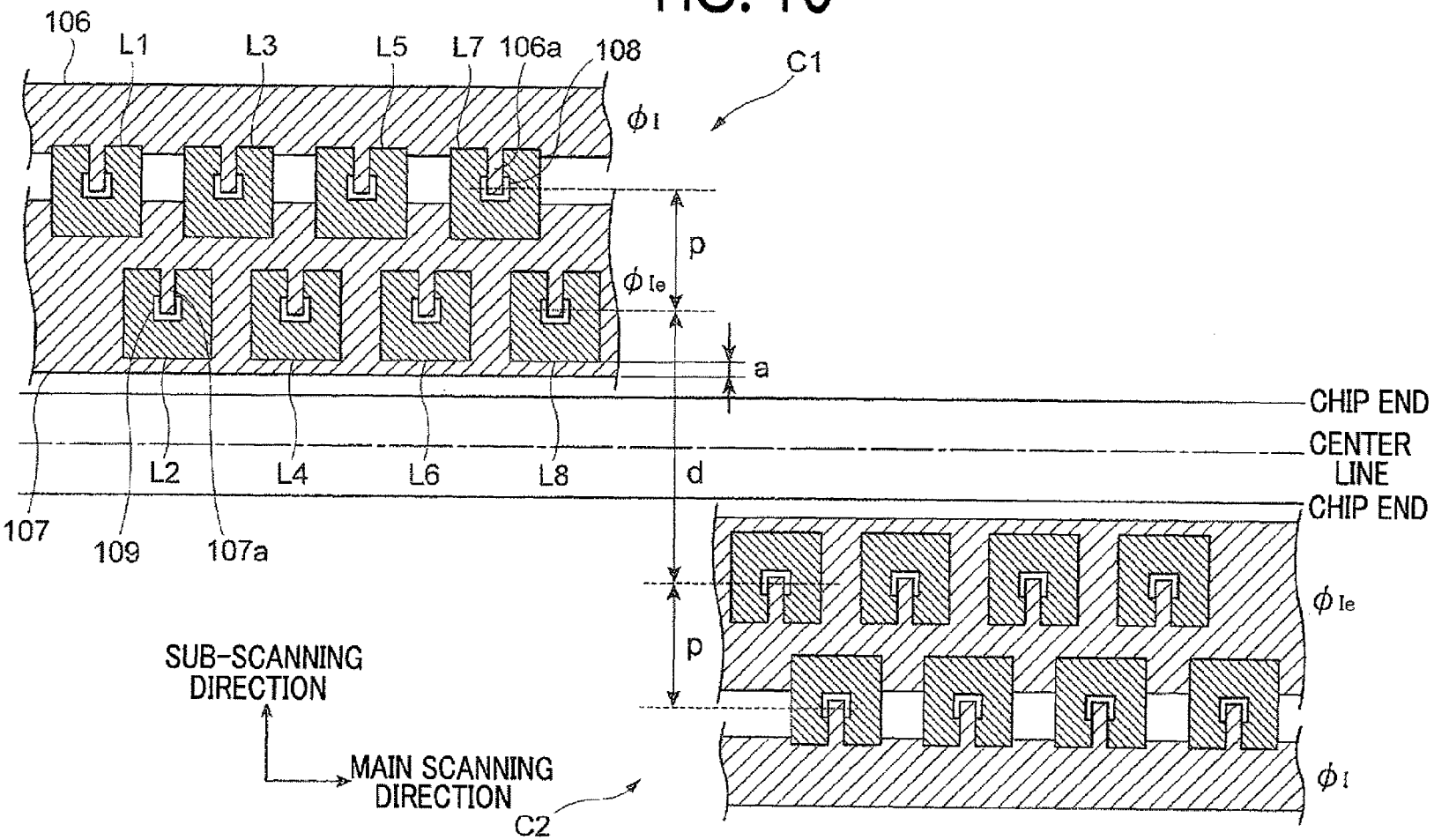
FIG. 10 is a diagram illustrating a case in which the light emission signal line is provided so as to surround light emitting elements forming a second light emitting element row.

FIG. 10 is a diagram illustrating a case in which the light emission signal line 107 is provided so as to surround the light emitting elements forming the second light emitting element row.

In the light emitting chip C1 shown in FIG. 10, the light emission signal line 107 provided on the lower side of the second light emitting element row in FIG. 10 has a width a. As such, when the light emission signal line 107 is provided so as to surround the even-numbered light emitting thyristors L forming the second light emitting element row, it is possible to further reduce the internal resistance of the light emission signal line 107. It is preferable that the light emission signal line 106 and the light emission signal line 107 have substantially the same internal resistance in order to prevent a variation in the optical output emitted from the light emitting thyristor L. In this exemplary embodiment, the width a shown in FIG. 10 is adjusted to adjust the internal resistance of the light emission signal line 107. It is preferable that the width a be not very large in order to reduce the distance d. Therefore, the width a is determined in the range in which the focus performance of the rod lens array 64 does not deteriorate.

The light emitting thyristor L of the light emitting chip C shown in FIGS. 7 and 10 has a rectangular shape, but the invention is not limited thereto.

Figure 11:
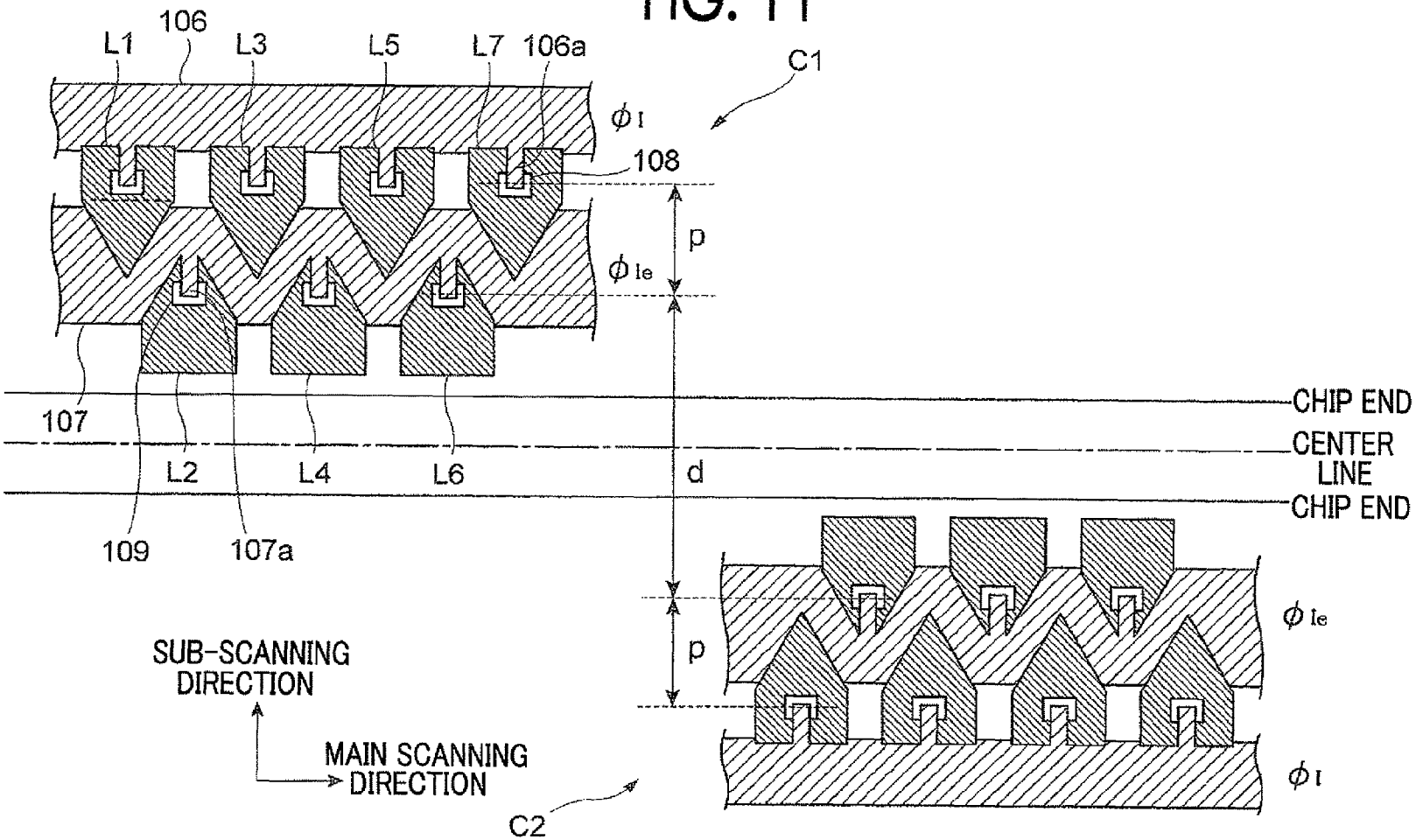
FIG. 11 is a diagram illustrating a light emitting chip in which a light emitting thyristor has a pentagonal shape.

FIG. 11 is a diagram illustrating a light emitting chip C in which a light emitting thyristor L has a pentagonal shape.

The light emitting chip C1 shown in FIG. 11 is similar to the light emitting chip C1 shown in FIG. 7 in the arrangement of the light emitting thyristors L, the light emission signal line 106, and the light emission signal line 107. However, the light emitting thyristor L has a pentagonal shape which is a combination of a rectangle and a triangle (a dotted line indicates the boundary between the triangle and the rectangle in a light emitting thyristor L1 of the light emitting chip C1) and the light emitting thyristors L are arranged in a zigzag such that the vertexes of the triangular portions in the adjacent light emitting thyristors L face each other in the vertical direction. That is, the vertexes of the triangular portions in the odd-numbered light emitting thyristors L face downward in FIG. 11 and the vertexes of the triangular portions in the even-numbered light emitting thyristors L face upward in FIG. 11. In this way, in the odd-numbered light emitting thyristors L forming the first light emitting element row and the even-numbered light emitting thyristors L forming the second light emitting element row, the positions of the triangular portions are combined with each other. The light emission signal line 107 is provided in the regions between the odd-numbered light emitting thyristors L forming the first light emitting element row and between the even-numbered light emitting thyristors L forming the second light emitting element row. In this way, the light emission signal line 107 is arranged between the first light emitting element row and the second light emitting element row in a zigzag in the main scanning direction. The light emitting thyristor may have a hexagonal shape which is a combination of a rectangle and a trapezoid. In this case, the same arrangement may be obtained.

When the light emitting thyristor L of the light emitting chip C1 is configured in this way, it is possible to increase the area of the light emitting thyristor L. This may be rephrased as "space efficiency is improved when the pentagonal light emitting thyristor L is used". Therefore, the optical output from the light emitting thyristor L is likely to be improved.

In the example shown in FIG. 11, the light emitting thyristor L has the pentagonal shape. However, the light emitting thyristor L may have other polygonal shapes, such as a hexagonal shape or an octagonal shape. In addition, the light emitting thyristor L may have a curved shape, such as a circular shape or an elliptical shape. However, it is preferable that the light emitting thyristor L have the rectangular shape, the pentagonal shape, or the hexagonal shape in order to further increase the area of the light emitting thyristor L and the optical output without excessively increasing the distance d and the gap p. It is more preferable that the light emitting thyristor L have the pentagonal shape or the hexagonal shape.

In the above-mentioned example, the branch line 107*a* extends from the upper side of the drawings to the electrode 109 that is provided in the vicinity of the center of the light emitting thyristor L and is connected to the electrode 109.

However, the invention is not limited thereto. The branch line 107*a* may extend to the electrode 109 in other directions and may be connected to the electrode 109.

Figure 12:
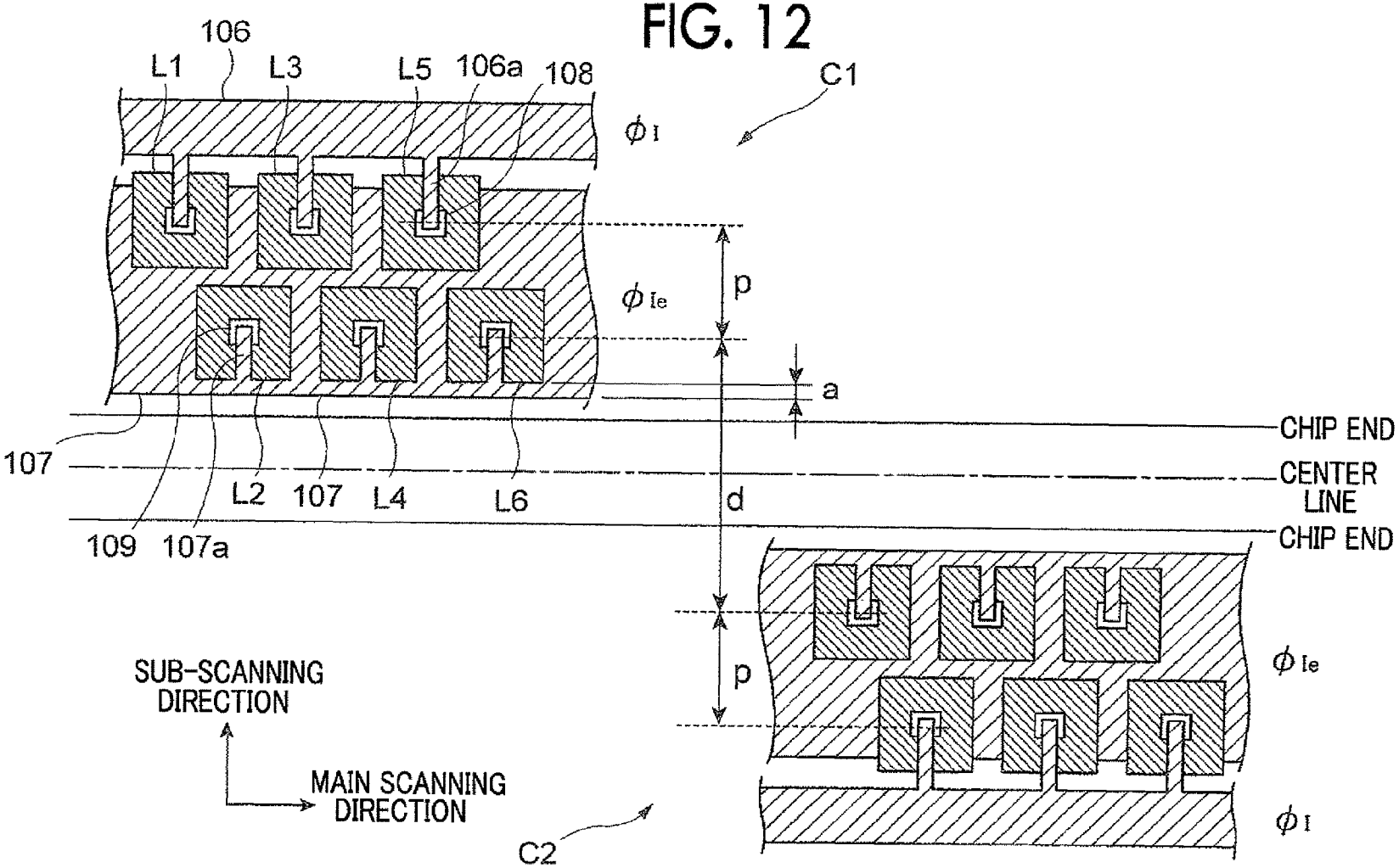
FIG. 12 is a diagram illustrating an example in which the arrangement of branch lines is changed, as compared to that shown in FIG. 10.

FIG. 12 shows an example in which the arrangement of the branch line 107*a* is changed as compared to the arrangement shown in FIG. 10.

The light emitting chip C1 shown in FIG. 12 differs from the light emitting chip C1 shown in FIG. 10 in that the branch line 107*a* extends from the lower side of FIG. 12 to the electrode 109 which is provided in the vicinity of the center of the light emitting thyristor L and is connected to the electrode 109.

Figure 13:
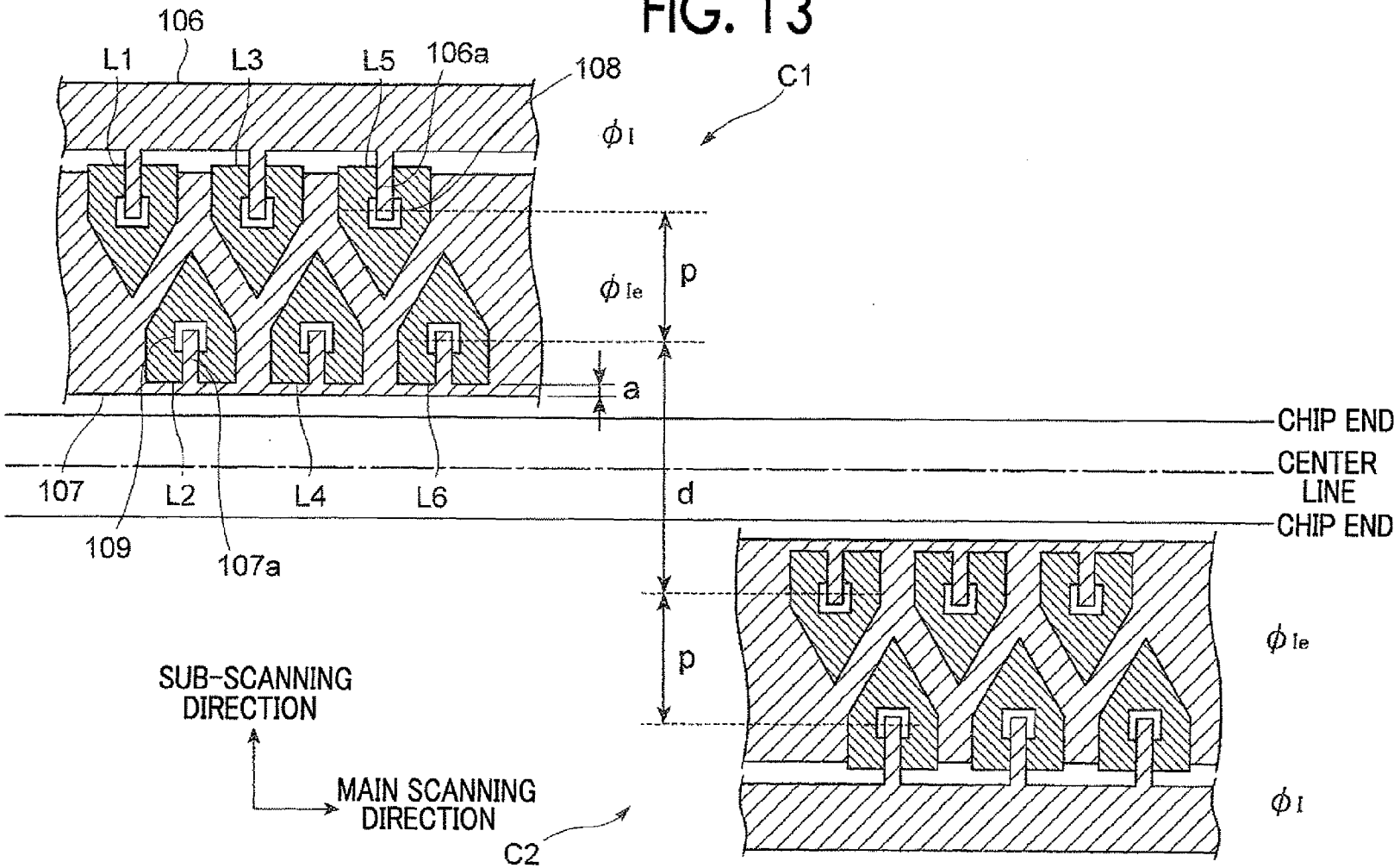
FIG. 13 is a diagram illustrating an example in which the arrangement of the branch lines is changed, as compared to that shown in FIG. 11.

FIG. 13 shows an example in which the arrangement of the branch line 107*a* is changed as compared to the arrangement shown in FIG. 11.

The light emitting chip C1 shown in FIG. 13 differs from the light emitting chip C1 shown in FIG. 11 in that the branch line 107*a* extends from the lower side of FIG. 13 to the electrode 109 which is provided in the vicinity of the center of the light emitting thyristor L and is connected to the electrode 109.

In the above-mentioned example, the odd-numbered light emitting thyristors L form the first light emitting element row and the even-numbered light emitting thyristors L form the second light emitting element row. However, the invention is not limited thereto. That is, the even-numbered light emitting thyristors L may form the first light emitting element row and the odd-numbered light emitting thyristors L may form the second light emitting element row.

Figure 14:
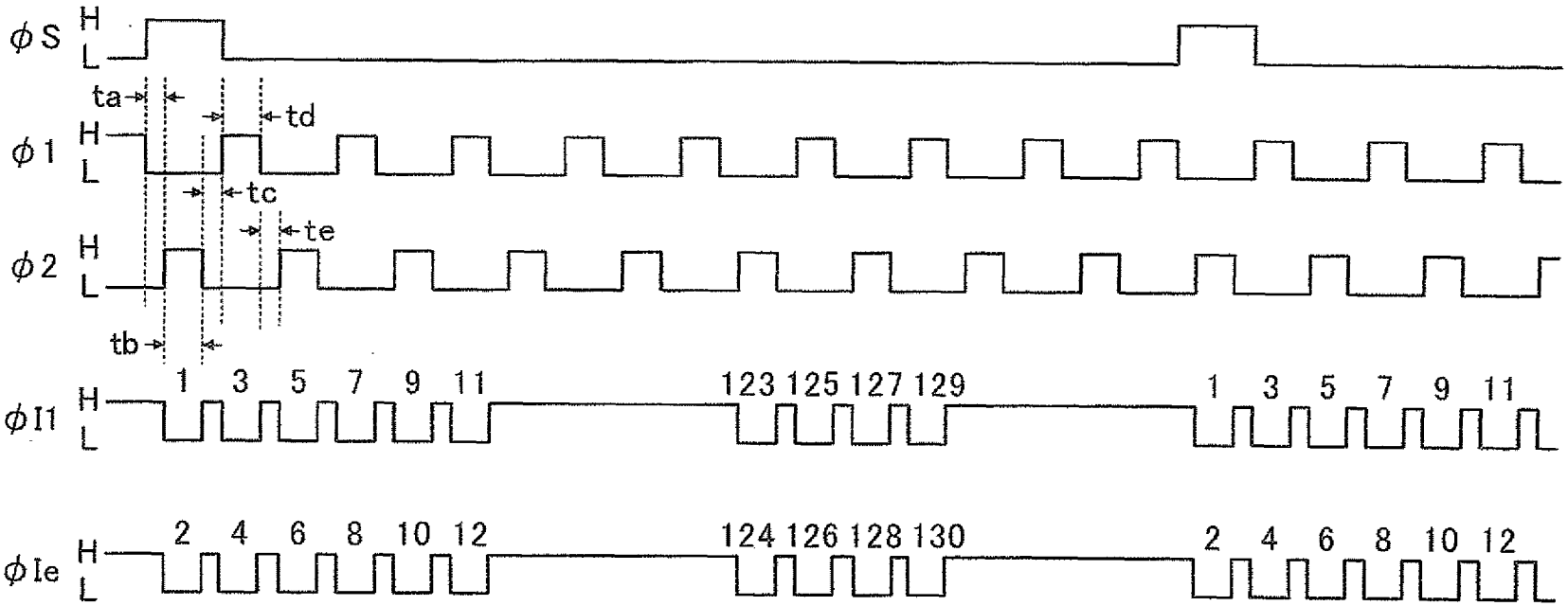
FIG. 14 is a timing chart.

Next, the operation of the light emitting chip in an exposure operation will be described in detail with reference to the timing chart shown in FIG. 14. In FIG. 14, for convenience of explanation, a case in which the light emitting thyristors L are sequentially turned on in the main scanning direction will be described.

It is assumed that, in an initial state, the start transmission signal φS is set to a low level (L), the first transmission signal φ1 is set to a high level (H), the second transmission signal φ2 is set to a low level, and the light emission signals φI and φIe are set to a high level.

When an operation starts, the start transmission signal φS input from the signal generating circuit 100 is changed from the low level to a high level. Then, a high-level start transmission signal φS is supplied to the gate terminal G1 of the transmission thyristor S1 of the light emitting chip C. In this case, the start transmission signal φS is also supplied to the gate terminals G2 to G65 of the other transmission thyristors S2 to S65 through the diodes D1 to D64. However, since a voltage drop occurs in each of the diodes D1 to D64, the highest voltage is applied to the gate terminal G1 of the transmission thyristor S1.

The first transmission signal φ1 input from the signal generating circuit 100 is changed from the high level to the low level with the start transmission signal φS at the high level. After a first period to has elapsed from the change in the first transmission signal φ1 to the low level, the second transmission signal φ2 is changed from the low level to the high level.

As such, when the low-level first transmission signal φ1 is supplied with the start transmission signal φS at the high level, the transmission thyristor S1 with the highest gate voltage equal to or more than a threshold value is turned on among the odd-numbered transmission thyristor S1, S3, . . . , S65 to which the low-level first transmission signal φ1 is supplied in the light emitting chip C. In this case, since the second transmission signal φ2 is at the high level, the cathode voltage of the even-numbered transmission thyristors S2, S4, . . . , S64 is maintained at a high level and the even-numbered transmission thyristors S2, S4, . . . , S64 are maintained in the off state. In this case, in the light emitting chip C, only the odd-numbered transmission thyristors S1 are turned on. Then, the odd-numbered transmission thyristor S1 and the light emitting thyristors L1 and L2 with the gates connected to each other are turned on and may emit light.

After a second period tb has elapsed from the change in the second transmission signal φ2 to the high level with the transmission thyristor S1 turned on, the second transmission signal φ2 is changed from the high level to the low level. Then, among the even-numbered transmission thyristors S2, S4, . . . , S64 to which the low-level second transmission signal φ2 is supplied, the transmission thyristor S2 with the highest gate voltage equal to or more than a threshold value is turned on. In this case, in the light emitting chip C, both the odd-numbered transmission thyristor S1 and the adjacent even-numbered transmission thyristor S2 are turned on. Then, in addition to the light emitting thyristors L1 and L2 which have been turned on, the even-numbered transmission thyristor S2 and the light emitting thyristors L3 and L4 with the gates connected to each other are turned on and may emit light.

After a third period tc has elapsed from the change in the second transmission signal φ2 to the low level with the transmission thyristor S1 and the transmission thyristor S2 turned on, the first transmission signal φ1 is changed from the low level to the high level. Then, the odd-numbered transmission thyristor S1 is turned off and only the even-numbered transmission thyristor S2 is turned on. Then, the light emitting thyristors L1 and L2 are turned off and may not emit light. Only the light emitting thyristors L3 and L4 are maintained in the on state and may emit light. In this example, the start transmission signal φS is changed from the high level to the low level when the first transmission signal φ1 is changed to the high level.

After a fourth period td has elapsed from the change in the first transmission signal φ1 to the high level with the transmission thyristor S2 turned on, the first transmission signal φ1 is changed from the high level to the low level. Then, among the odd-numbered transmission thyristor S1, S3, . . . , S65 to which the low-level first transmission signal φ1 is supplied, the transmission thyristor S3 with the highest gate voltage is turned on. In this case, in the light emitting chip C, both the even-numbered transmission thyristor S2 and the adjacent odd-numbered transmission thyristor S3 are turned on. Then, in addition to the light emitting thyristors L3 and L4 which have been turned on, the odd-numbered transmission thyristor S3 and the light emitting thyristors L5 and L6 with the gates connected to each other are turned on and may emit light.

After a fifth period to has elapsed from the change in the first transmission signal φ1 to the low level with the transmission thyristor S2 and the transmission thyristor S3 turned on, the second transmission signal φ2 is changed from the low level to the high level. Then, the even-numbered transmission thyristor S2 is turned off and only the odd-numbered transmission thyristor S3 is turned on. Then, the light emitting thyristors L3 and L4 are turned off and may not emit light. Only the light emitting thyristors L5 and L6 are maintained in the on state and may emit light.

As such, in the light emitting chip C, an overlap period for which both the first transmission signal φ1 and the second transmission signal φ2 are at the low level is provided and the first transmission signal φ2 and the second transmission signal φ2 are alternately switched between the high level and the low level to sequentially turn on the transmission thyristors S1 to S65 in the order of the numbers. Then, the light emitting thyristors L1 to L130 are turned on two by two in the order of the numbers. In this case, for the second period tb, only the odd-numbered transmission thyristor (for example, the transmission thyristor S1) is turned on. For the third period tc, the odd-numbered transmission thyristor and the next even-numbered transmission thyristor (for example, the transmission thyristor S1 and the transmission thyristor S2) are turned on. For the fourth period td, only the even-numbered transmission thyristor (for example, the transmission thyristor S2) is turned on. For the fifth period te, the even-numbered transmission thyristor and the next odd-numbered transmission thyristor (for example, the transmission thyristor S2 and the transmission thyristor S3) are turned on. Then, for the second period tb, only the odd-numbered transmission thyristor (for example, the transmission thyristor S3) is turned on again. This process is repeatedly performed.

Basically, the light emission signals ϕI and ϕIe are changed from the high level to the low level and from the low level to the high level for the second period tb for which the odd-numbered transmission thyristor is independently turned on and the fourth period td for which the even-numbered transmission thyristor is independently turned on, respectively.

As such, in the light emitting chip C according to this exemplary embodiment, since the light emitting thyristors L are turned on two by two, it is possible to increase the amount of light output from the light emitting chip C. In the above-mentioned example, the light emission signals ϕI and ϕIe are turned on and off in the same pattern, thereby performing control such that the light emitting thyristors L are turned on two by two. However, the invention is not limited thereto. That is, the light emission signals ϕI and ϕIe may be turned on and off in different patterns to turn on the light emitting thyristors L one by one. In this case, it is possible to obtain resolution that is two times more than that in the above-mentioned example. For example, it is possible to obtain a resolution of 1200 dpi (dots per inch) while a resolution of 600 dpi is obtained in the above-mentioned example.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A light emitting element array chip comprising:

a first light emitting element row including light emitting elements that are arranged in a row in a main scanning direction;

a second light emitting element row including light emitting elements that are arranged in a row in the main scanning direction and are provided between the light emitting elements forming the first light emitting element row such that the light emitting elements are arranged in a zigzag;

a first light emission signal line that extends toward the main scanning direction and that transmits a light emission signal for allowing the light emitting elements forming the first light emitting element row to emit light; and a second light emission signal line that extends toward the main scanning direction and that transmits a light emission signal for allowing the light emitting elements forming the second light emitting element row to emit light, wherein the first light emission signal line is arranged in one side of the first light emitting element row and is not provided in the other side of the first light emitting element row, and the second light emission signal line is arranged in the other side of the first light emitting element row, wherein the second light emission signal line is provided between the first light emitting element row and the second light emitting element row and is provided in regions between the light emitting elements forming the first light emitting element row and between the light emitting elements forming the second light emitting element row, wherein the second light emission signal line is arranged so as to surround the light emitting elements forming the second light emitting element row.

2. The light emitting element array chip according to claim 1, wherein the light emitting elements forming the first light emitting element row and the light emitting elements forming the second light emitting element row have a pentagonal shape or a hexagonal shape.

3. The light emitting element array chip according to claim 1, wherein the light emitting elements forming the first light emitting element row and the light emitting elements forming the second light emitting element row have a pentagonal shape or a hexagonal shape.

4. A light emitting element head comprising:

a first light emitting element row including light emitting elements that are arranged in a row in a main scanning direction;

a second light emitting element row including light emitting elements that are arranged in a row in the main scanning direction and are provided between the light emitting elements forming the first light emitting element row such that the light emitting elements are arranged in a zigzag;

a first light emission signal line that extends toward the main scanning direction and that transmits a light emission signal for allowing the light emitting elements forming the first light emitting element row to emit light;

a second light emission signal line that extends toward the main scanning direction and that transmits a light emission signal for allowing the light emitting elements forming the second light emitting element row to emit light; and an optical element that focuses an optical output emitted from the light emitting elements forming the first light emitting element row and the light emitting elements forming the second light emitting element row and exposes a photoconductor such that an electrostatic latent image is formed, wherein the first light emission signal line is arranged in one side of the first light emitting element row and is not provided in the other side of the first light emitting element row, and the second light emission signal line is arranged in the other side of the first light emitting element row, wherein the second light emission signal line is provided between the first light emitting element row and the second light emitting element row and is provided in regions between the light emitting elements forming the first light emitting element row and between the light emitting elements forming the second light emitting element row, wherein the second light emission signal line is arranged so as to surround the light emitting elements forming the second light emitting element row.

5. An image forming apparatus comprising:

a toner image forming unit that forms a toner image;

a transfer unit that transfers the toner image onto a recording medium; and a fixing unit that fixes the toner image to the recording medium, wherein the toner image forming unit includes:

a first light emitting element row including light emitting elements that are arranged in a row in a main scanning direction;

a second light emitting element row including light emitting elements that are arranged in a row in the main scanning direction and are provided between the light emitting elements forming the first light emitting element row such that the light emitting elements are arranged in a zigzag;

a first light emission signal line that extends toward the main scanning direction and that transmits a light emission signal for allowing the light emitting elements forming the first light emitting element row to emit light;

a second light emission signal line that extends toward the main scanning direction and that transmits a light emission signal for allowing the light emitting elements forming the second light emitting element row to emit light; and an optical element that focuses an optical output emitted from the light emitting elements forming the first light emitting element row and the light emitting elements forming the second light emitting element row and exposes a photoconductor such that an electrostatic latent image is formed, and the first light emission signal line of the toner image forming unit is arranged in one side of the first light emitting element row and is not provided in the other side of the first light emitting element row, and the second light emission signal line is arranged in the other side of the first light emitting element row, wherein the second light emission signal line is provided between the first light emitting element row and the second light emitting element row and is provided in regions between the light emitting elements forming the first light emitting element row and between the light emitting elements forming the second light emitting element row, wherein the second light emission signal line is arranged so as to surround the light emitting elements forming the second light emitting element row.

* * * * *